United States Patent [19]

Schellhorn

[11] Patent Number: 4,793,740

[45] Date of Patent: Dec. 27, 1988

[54] DRILLING SYSTEM

[75] Inventor: Verne L. Schellhorn, Gualala, Calif.

[73] Assignee: Foundation Constructors, Antiock, Calif.

[21] Appl. No.: 935,772

[22] Filed: Nov. 28, 1986

[51] Int. Cl.[4] ..... E02D 7/00; F21B 10/44

[52] U.S. Cl. ..... 405/232; 175/65; 175/394; 405/248

[58] Field of Search ..... 405/232, 233, 241, 248, 405/249, 256; 175/65, 394

[56] References Cited

U.S. PATENT DOCUMENTS

| | | | |
|---|---|---|---|
| 1,734,672 | 11/1929 | Harralson . | |
| 2,129,978 | 9/1938 | Yokoyama | 405/248 |
| 2,199,692 | 5/1940 | Catland . | |
| 2,218,130 | 10/1940 | Court . | |
| 2,354,936 | 8/1944 | Bignell | 405/248 |
| 2,357,835 | 9/1944 | Leissler . | |
| 2,582,312 | 1/1952 | Del'Homme . | |
| 3,363,706 | 1/1968 | Feenstra . | |
| 3,369,617 | 2/1968 | Brack et al. . | |
| 3,563,324 | 2/1971 | Lauber . | |
| 3,753,597 | 8/1973 | French . | |
| 3,938,344 | 2/1976 | Asayama | 405/248 X |
| 4,303,136 | 12/1981 | Ball . | |
| 4,327,507 | 5/1982 | Volbeda . | |
| 4,452,324 | 6/1984 | Jurgens . | |
| 4,515,227 | 5/1985 | Cerkovnik . | |
| 4,637,758 | 1/1987 | Tamaki et al. | 405/248 |
| 4,659,257 | 4/1987 | Verstraeten | 405/232 X |

FOREIGN PATENT DOCUMENTS

| | | |
|---|---|---|
| 825833 | 4/1981 | U.S.S.R. . |

*Primary Examiner*—David H. Corbin

*Attorney, Agent, or Firm*—James R. Cypher

[57] ABSTRACT

A drilling system is provided wherein a high pressure water jet is provided near the cutting tip of the auger, the water jet being directed upwardly into the slip stream of spoil to break up the spoil and reduce friction between the spoil and the auger.

4 Claims, 2 Drawing Sheets

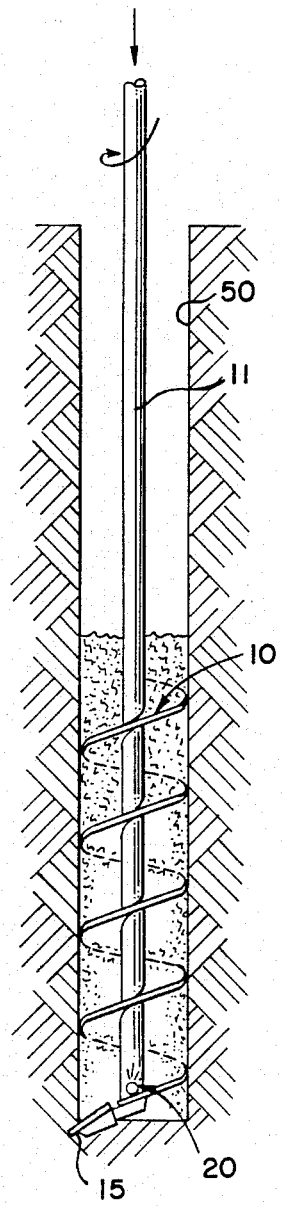
FIG. 4A
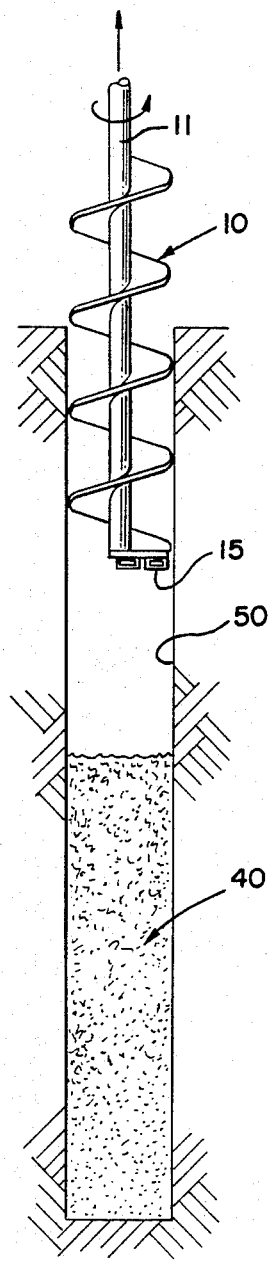
FIG. 4B
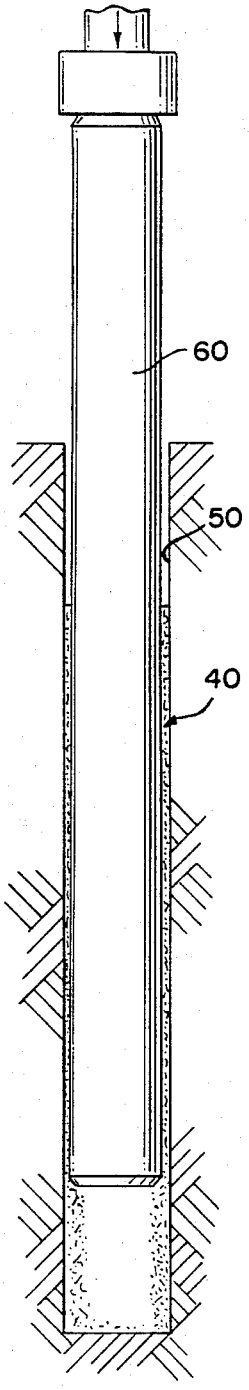
FIG. 4C
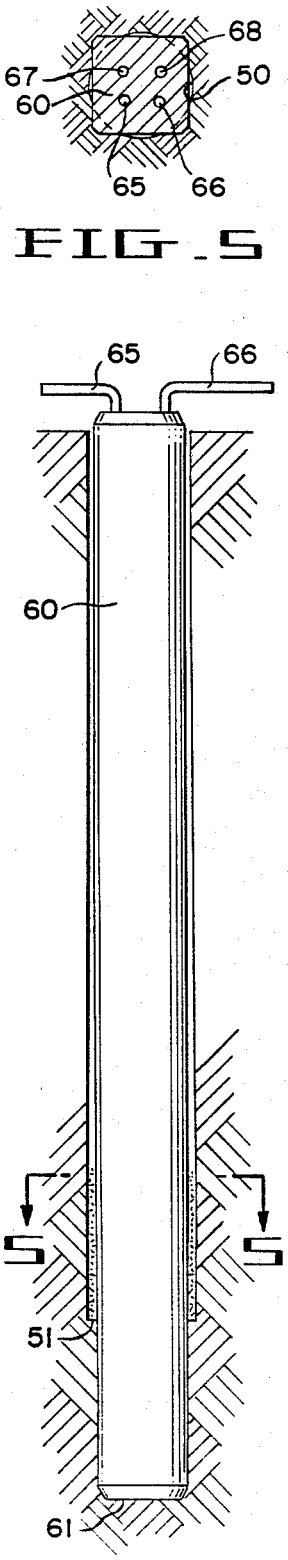
FIG. 5
FIG. 4D

DRILLING SYSTEM

SUMMARY OF THE INVENTION

This invention relates generally to pile driving and more specifically to a system wherein a prebore is drilled before a pile is driven. This procedure facilitates driving the pile in less time, with fewer hammer blows and with less noise.

The present invention includes a high pressure water jet near the drilling bit which is directed upwardly away from the drill bit. The water jet breaks up and fluidizes the spoil and reduces friction between the spoil and the auger. Fluidized spoil may be left in the prebore as the pile is driven; the fluidized spoil is displaced by the driven pile and fills any space between the pile and the prebore as the pile is driven.

A primary object of the invention is to provide a system for pile driving wherein a prebore is drilled utilizing a high pressure, low volume water jet near the drill bit directed into the slip stream of spoil to break up and fluidize spoil.

A further object of the invention is to provide an improved system for drilling prebores for piling wherein a high pressure water jet is provided near the cutting tip and is directed upwardly and generally away from the cutting tip.

Another object of the invention is to provide a system for pile driving which is faster, cheaper and quieter than prior systems.

Another object of the invention is to provide a system for pile driving wherein fluidized spoil in a prebore is displaced by a driven pile and as the moisture in the spoil dissipates it augments the frictional engagement of the pile with the prebore.

BRIEF DESCRIPTION OF THE DRAWINGS

FIGS. 4A–4D are schematic representations of how a pile can be driven in accordance with the invention; and FIG. 5 is a view on the line 5—5 of FIG. 4D.

DETAILED DESCRIPTION OF THE DRAWINGS

Figure 1:
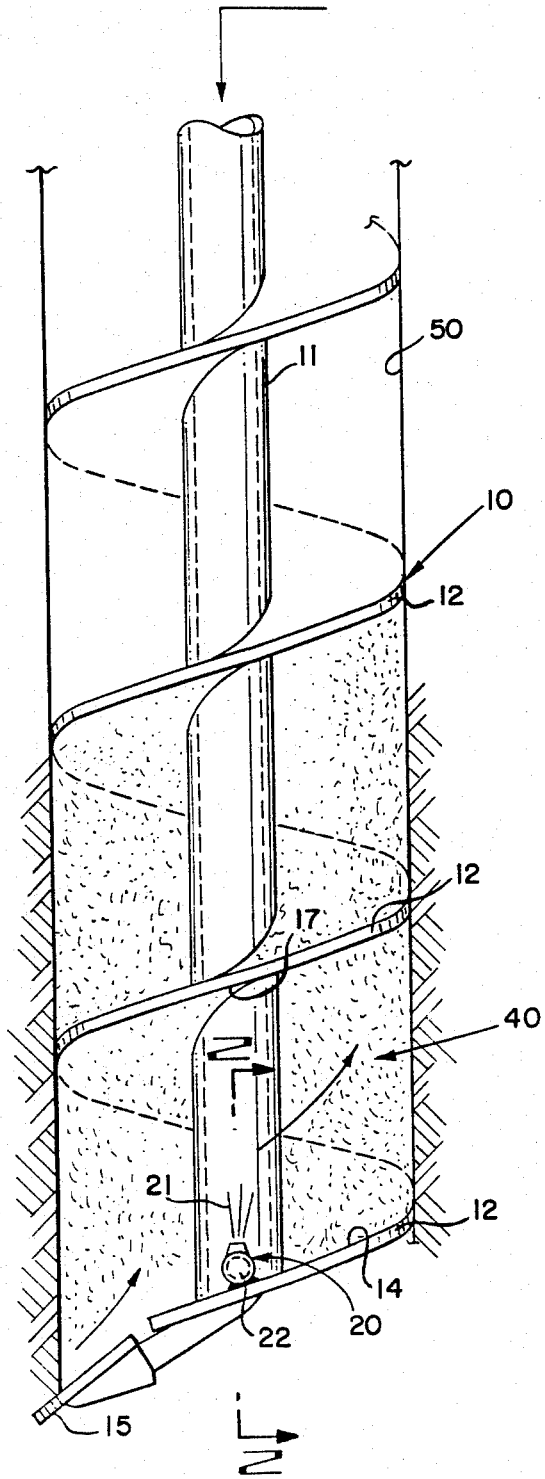
FIG. 1 is an elevational view of an auger including a water jet in accordance with the invention.
Figure 2:
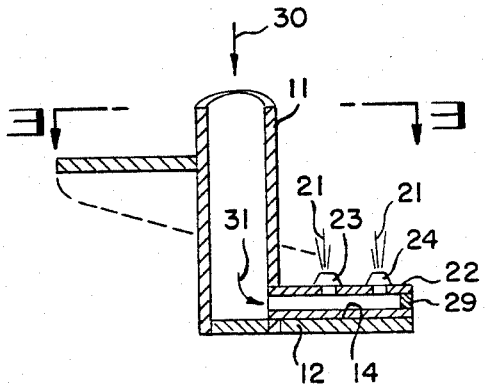
FIG. 2 is a view on the line 2—2 of FIG. 1.

As shown in FIGS. 1 and 2, an auger 10 is provided having a hollow stem 11, a single helical flight 12 and a conventional cutting tip 15.

Nozzle means 20 is located near cutting tip 15, and provides a water jet or jets 21 directed generally upwardly and generally away from the direction of advancement of cutting tip 15. Nozzle means 20 comprises a hollow pipe 22 which extends perpendicularly to stem 11 and along the upper surface 14 of flight 12. Pipe 22 in the embodiment shown is one inch in diameter, and has a plug 29 at its outer end. The upper surface of pipe 22 has a pair of jets 23 and 24 mounted thereon, which in the embodiment shown are each 3/16" diameter and are each oriented vertically. The interior of pipe 22 communicates with the interior of hollow stem 11 as shown in FIG. 2. Water is fed into hollow stem 11 along the path of arrows 30 and 31 in the embodiment shown at 400 psi when using a constant displacement pump which pumps 60 gallons per minute.

As cutting tip 15 advances, spoil 40 passes over the upper surface of helical flight 12 forming a slip stream of spoil and passes over pipe 22 with jets 23 and 24. The high pressure water jet 21 breaks up and fluidizes the spoil, reducing friction between the spoil and helical flight 12. As a consequence, the hole or prebore 50 may be drilled in less time than without using the water jet. It is important that the water jet be oriented in a way to avoid enlarging the diameter of the hole 50, in order to maximize the frictional engagement between the sides of the pile to be driven and the side walls of the prebore 50. I have found that when drilling clay with a 14" diameter auger with a 12" pitch in a single helical flight, a water pressure of 400 psi is generated with a constant displacement pump pumping 60 gallons per minute when using two 3/16" diameter jets. The resulting water jets sufficiently break up and fluidize the spoil and increase the drilling speed by 20% or more. I have found that a pressure of 100 psi with two 3/16" diameter jets provides marginally effective break up of spoil, but not as effectively as 400 psi. The object is to provide a high enough pressure to obtain good break up of spoil without putting too much water in the hole, which tends to enlarge the diameter of the hole. Smaller jets could be used with the same constant displacement pump, thereby increasing the pressure of the water jets. The higher the pressure, the more effective the breaking up of spoil. The best water pressure for a given hole site varies with soil conditions, drill speed and size and number of jets.

Figure 3:
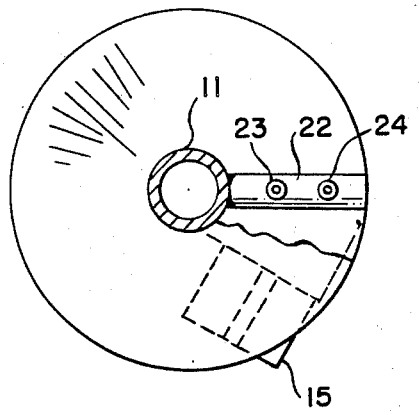
FIG. 3 is a view on the line 3—3 of FIG. 2.

The closer nozzle means 20 is located to cutting tip 15, the less the friction tends to be between flight 12 and the spoil. I have found that the nozzle means 20 is preferably located along helical flight 12 within a 90° arc from cutting tip 15 as shown best in FIG. 3. It is also within the scope of this invention to mount the pipe 22 on the lower surface 17 of flight 12 with a water jet or jets directed downwardly into the spoil, although this variation is not as effective as the embodiment shown in the drawings.

Referring to FIGS. 4A–4D, FIG. 4A represents drilling the prebore 50 as discussed above. As shown in FIG. 4B, the auger is rotated in the direction opposite the direction for drilling as it is withdrawn from the prebore 50, leaving at least a portion of the fluidized spoil 40 in the prebore.

FIG. 4C shows a reinforced concrete pile 60 being driven into the prebore 50, and displacing or forcing the fluidized spoil 40 upwardly, filling any spaces between the pile and the side wall of the prebore.

I have found that a 14" diameter prebore 50 is preferred for a 14" square pile 60 as shown schematically in FIG. 5. As shown in FIG. 4D, the pile 60 with reinforcing tendons 65, 66, 67, 68 is driven past the lower end 51 of prebore 50 to insure end loading of the base 61 of pile 60.

After the pile is driven, as shown in FIG. 4D, water dissipates out of the fluidized spoil and away from the prebore; eventually the fluidized spoil "equalizes" with adjacent soil, in that the water content of the fluidized spoil approaches the water content of the adjacent soil. As this "equalizing" occurs, the frictional engagement between the pile and the wall of the prebore increases. Since the solids in the fluidized spoil are essentially the same as the side walls of the prebore, those solids adhere quite well to the side walls as the spoil equalizes. In field tests, the frictional engagement using the present invention appears to be equal to a pile driven without a prebore, assuming enough time has elapsed to allow the spoil to fully equalize.

I claim:

1. In a drilling rig used for drilling prebores for piling wherein an auger having a plurality of helical flights and having a lower leading edge is used wherein said helical flights of said auger have an upper surface and said auger has a cutting tip mounted at said lower leading edge of said helical flights and wherein spoil passes over said cutting tip and across said upper surface of the lowermost portion of said plurality of helical flights, thereby forming a slip stream of spoil, the improvement comprising:

(a) nozzle means carried by said upper surface of said lowermost helical flight adjacent said cutting tip for directing a high pressure fluid jet generally upwardly into said slip stream of spoil without enlarging the diameter of said prebore beyond the diameter of said cutting tip to help break up the spoil and reduce the friction between the slip stream of spoil and said auger flight, and (b) fluid supply means for directing high pressure fluid to said nozzle means.

2. The apparatus of claim 1 wherein the fluid is supplied at a pressure of at least 100 psi.

3. The apparatus of claim 1 wherein:

(a) said nozzle means is located along said helical flight within a 90° arc from said cutting tips.

4. A method for driving piling comprising the following steps:

(a) boring a hole to a selected depth with an auger, while simultaneously directing a high pressure, low volume fluid jet near the cutting tip of said auger upwardly into the slip steam of spoil, without enlarging the diameter of said bore, thereby fluidizing said spoil as said auger advances downwardly in said hole, (b) withdrawing said auger by rotating it and leaving at least a portion of the fluidized spoil in said hole, (c) placing a pile in said hole and driving said pile to a point below said selected depth of said hole having fluidized spoil whereby said fluidized spoil is displaced by said pile and is forced into any spaces between said pile and the walls of said hole, and (d) allowing said fluid in said fluidized spoil to flow away from said hole, whereby said spoil increased its frictional engagement with the surface of said pile as time passes and said spoil equalizes.

* * * * *